US005768843A

United States Patent [19]

Dziedzic

[11] Patent Number: 5,768,843

[45] Date of Patent: Jun. 23, 1998

[54] APPARATUS AND METHOD FOR MOUNTING SUSPENSION CEILING PANELS

[76] Inventor: Jerome J. Dziedzic, 5350 S. Cambridge La., Greenfield, Wis. 53221

[21] Appl. No.: 734,094

[22] Filed: Oct. 21, 1996

[51] Int. Cl.[6] ..... E04B 9/18

[52] U.S. Cl. ..... 52/506.06; 52/39; 248/228.7; 248/340

[58] Field of Search ..... 52/39, 506.06, 52/506.07; 248/72, 228.1, 228.7, 228.8, 340

[56] References Cited

U.S. PATENT DOCUMENTS

| | | | |
|---|---|---|---|
| 1,613,394 | 1/1927 | Harris | 248/72 X |
| 2,020,815 | 11/1935 | Venzie | 52/506.06 X |
| 2,099,211 | 11/1937 | Lucius . | |
| 2,370,379 | 2/1945 | Trippensee . | |
| 2,667,667 | 2/1954 | Jacobson . | |
| 3,102,614 | 9/1963 | Lydard | 52/506.06 X |
| 4,272,937 | 6/1981 | Brugman . | |
| 4,598,521 | 7/1986 | Slapsys et al. . | |
| 5,331,785 | 7/1994 | Brak | 52/506.06 X |

FOREIGN PATENT DOCUMENTS

| | | | |
|---|---|---|---|
| 254474 | 5/1963 | Australia | 52/506.07 |
| 423352 | 4/1911 | France | 52/506.06 |
| 2823036 | 11/1979 | Germany | 52/506.06 |
| 249305 | 4/1948 | Switzerland | 52/506.06 |
| 357533 | 11/1961 | Switzerland | 52/506.06 |

*Primary Examiner*—Carl D. Friedman
*Assistant Examiner*—Timothy B. Kang
*Attorney, Agent, or Firm*—Andrus, Sceales, Starke & Sawall

[57] ABSTRACT

A system for mounting a series of ceiling panels beneath a floor supporting joist having laterally extending support surfaces includes at least one resilient mounting clip suspendable from the support surfaces. The mounting clip is formed with a pair of spring biased hooked arms constructed and arranged to self-locate upon the support surfaces, and a retainer loop positioned in spaced relationship to the joist. A panel holding framework assembly is supported from the retainer loop and includes a panel holding framework supporting the ceiling panels.

13 Claims, 1 Drawing Sheet

APPARATUS AND METHOD FOR MOUNTING SUSPENSION CEILING PANELS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The invention relates broadly to ceiling construction and, more particularly, pertains to a method and apparatus for installing a ceiling suspended from the floor structure above a room.

Constructing a suspension ceiling is one of the quickest and most economical ways of concealing unattractive wiring, plumbing or duct work connected to the overlying floor, or altering an existing ceiling so as to change a design or cover up existing defects such as water stains, cracks or repair work.

In the course of installing a suspension ceiling, one must first perform a series of measurements which will establish various locations for the suspension ceiling components and vertical in horizontal planes. A group of nails or eye bolts is then spaced at predetermined intervals along the bottom surface of the joists supporting the overlying floor or existing ceiling structure. Once this is accomplished, one end of a suspension wire is twisted around each nail head or bolt eye while the other end, which is hung downwardly, is connected to a runner or cross-tee. The group of runners and cross-tees forms an intersecting grid system for accommodating a series of ceiling panels which are slidably and removably supported thereon in order to allow access, for example, to the space between the ceiling and the floor above, or to enable replacement of one or more ceiling panels.

The suspension ceiling installation procedure outlined above is an extremely labor-intensive process which makes it difficult to attain a desired look without investing substantial amounts of time and adjustments. In many situations, an installer is disappointed in the resulting sags or bellies in the suspension ceiling. In addition, it has also been discovered that use of the prior art installation procedures can lead to injuries. For example, stringing of the suspension wire and pounding of the nails or eye bolts has been known to inflict various cuts on one's hands and fingers.

Accordingly, it is desirable to provide a simplified system for mounting a series of suspension ceiling panels together in a consistent manner which minimizes the cost associated with the construction and installation of a suspension ceiling.

It is likewise desirable to design a suspension ceiling arrangement having a reasonable number of components which are installed with a minimum amount of time and effort. It is also desirable to supply a suspension ceiling mounting assembly in which the component parts are relatively lightweight and safe to handle. It is further desirable to offer a suspension ceiling construction which eliminates the need for nails, eye bolts and wire.

BRIEF SUMMARY OF THE INVENTION

The present invention advantageously provides an apparatus and method for mounting suspension ceiling panels which is reliant on the self-adjusting nature and the slidability of the components to ensure that the ceiling panels are uniformly spaced from the floor or overlying ceiling structure.

In one aspect of the invention, a kit is provided for mounting a series of ceiling panels on a panel holding framework suspended beneath a joist connected to a floor. The kit comprises a plurality of mounting clips suspendable from the joist, a plurality of leveling rods retainable in the mounting clips, and a plurality of hangers dependable from the leveling rods and adapted to support the panel holding framework and the ceiling panels thereon. The joist includes a top member secured to the floor, a bottom member having an upper support surface and a pair of side support surfaces for supporting the mounting clip, and a web interconnecting the top member and the bottom member. The bottom member has a width greater than the width of the web. Each of the mounting clips is constructed of drawn wire and includes a pair of resilient arms engageable with the upper support surface of the bottom member. The arms are further engageable against the side support surfaces of the bottom member. The arms merge together to form a retainer loop in which one of the leveling rods is slidably supported. Each of the mounting clips is self-locating and self-locking along the entire length of the joist. Each of the hangers has a first hooked end engageable with one of the leveling rods and a second hooked end engageable with an aperture formed in the panel holding framework. The panel holding framework is provided with laterally extending flanges for removably supporting the panels thereon.

In another aspect of the invention, a system is provided for mounting a series of ceiling panels beneath a floor supporting joist having laterally extending support surfaces. The system comprises at least one resilient mounting clip suspendable from the support surfaces. The mounting clip is formed with a pair of spring biased hooked arms constructed and arranged to self-locate upon said support surfaces, and a retainer loop positioned in spaced relationship to the joist. A panel holding framework assembly is supported from the retainer loop and includes a panel holding framework supporting the ceiling panels. The hooked arms extend upwardly above the support surfaces and terminate in downwardly depending fingers supported on the support surfaces. The depending fingers extend substantially perpendicularly to the support surfaces. The retainer loop is formed by parallel runs of the hooked arms folded over upon themselves, and defines a mounting position by which the panel holding framework assembly is laterally shiftable thereon.

In yet another aspect of the invention, there is contemplated a suspension ceiling system for removably mounting a series of ceiling panels on a panel holding framework assembly suspended beneath the floor supporting joist having a web joint substantially perpendicularly to a support member having a pair of support surfaces extending laterally from the web, and a pair of side support surfaces extending downwardly from the upper support surfaces. A mounting clip is provided for supporting and spacing the panel holding framework assembly from the joist. The mounting clip comprises a one-piece, resilient wire member having a pair of hooked arms having upper runs extending generally upwardly against the side support surfaces of the support member, curving inwardly towards the web and terminating in substantially downwardly depending fingers supported on the upper support surfaces of the support member. The hooked arms also include lower runs converging towards each other and running parallel to each other to form a retainer loop supporting each panel holding framework assembly at a distance spaced beneath the joist. The fingers extend substantially parallel to the web and substantially perpendicular to the upper support surfaces of the support member, and are self-locating along the upper support surfaces of the support member. The panel holding framework assembly includes a leveling rod slidably supported in the retainer loop and also includes a hanger extending downwardly between the leveling rod and the panel holding framework.

In yet another aspect of the invention, there is contemplated a method of mounting a series of ceiling panels on a panel holding framework suspended beneath the floor supporting joist having a web and a pair of support surfaces extending laterally thereon. The method comprises the steps of providing a series of mounting clips for supporting and spacing the panel holding framework from the joist, each of the mounting clips including a pair of resiliently biased arms engageable with the support surfaces and a retainer loop depending therefrom; securing the mounting clips to the joist by spreading the arms on opposite sides of the web and releasing the arms which will self-locate and be retained upon the support surfaces; providing a series of elongated leveling rods; slidably supporting the leveling rods in the retaining loops of the mounting clips; providing a series of hangers for supporting the panel holding framework; slidably supporting the hangers from the leveling rod; connecting the panel holding framework to the hangers; and installing the ceiling panels on the panel holding framework.

Various other objects, features and advantages of the invention will be made apparent from the following description taken together with the drawings.

BRIEF DESCRIPTION OF THE SEVERAL VIEWS OF THE DRAWING

The drawings illustrate the best mode presently contemplated of carrying out the invention.

In the drawings.

DETAILED DESCRIPTION OF THE INVENTION

Figure 1:
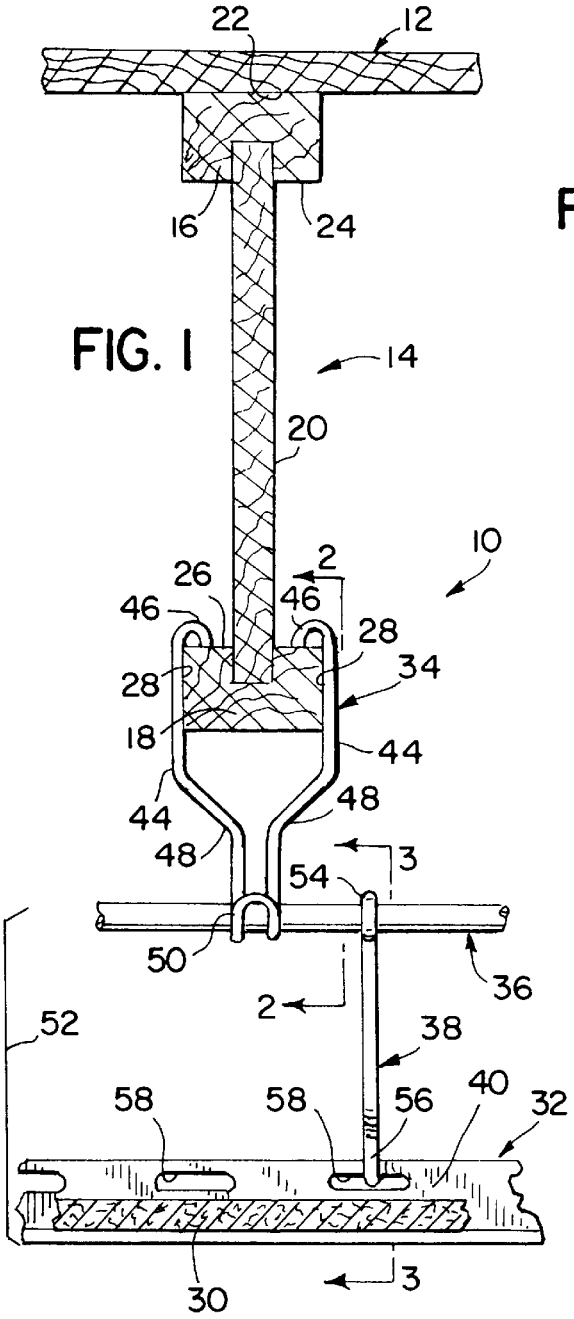
FIG. 1 is a front view of a suspension ceiling mounting system embodying the present invention.
Figure 2:
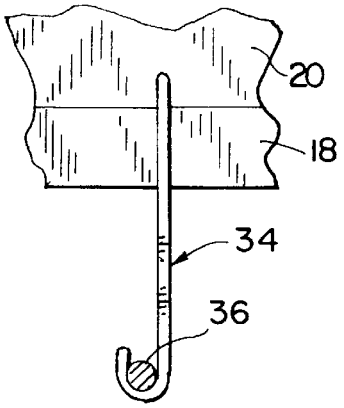
FIG. 2 is a fragmentary elevational view taken on line 2—2 of FIG. 1 showing a mounting clip employed in the present invention.
Figure 3:
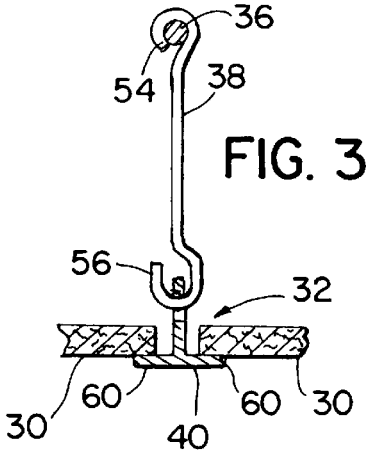
FIG. 3 is a fragmentary elevational view taken on line 3—3 of FIG. 1 showing a hanger employed in the present invention.

Referring now to FIG. 1, a suspension ceiling mounting system embodying the present invention is generally identified by the reference numeral 10. In such a system, a floor 12 is supported by a series of parallel, I-joists, only one of which is shown at 14. Each I-joist 14 functions to transfer downward stresses on the deck of floor 12 to the bearing walls (not shown) at the end of a span. I-joist 14 is typically comprised of prefabricated wood which offers several advantages over traditional solid sawn, dimensional lumber such as fir. As with all but the highest grade dimensional lumber, there are inherent flaws in the composition of a fir joist. As the wood dries, it tends to shrink and distort, which leads to other problems within the structure, such as cracked ceiling drywall and a reduced load bearing capacity of the floor. In addition, there are other flaws within each board such as knots and cracks which reduce the structural strength of a piece of lumber. Because they exhibit a resistance to water and moisture penetration and avoid shrinking or swelling that can cause squeaky floors, the I-joists are commonly referred to as a silent floor system. From a standpoint of handling, I-joist 14, which is typically available in 2 foot by 12 inch sizes, is much lighter than a previous wooden 2 foot by 10 inch fir joist. Although the following description is set forth in the environment of the I-joists, it should be understood that the suspension ceiling mounting system 10 will work equally well with trusses, beams, or other similar load bearing floor supporting members of various materials having the basic structure described herein.

Each I-joist 14 comprises a top member 16 which is in compression, a bottom member 18 which is in tension and a web 20 which helps the I-joist 14 react to shearing forces. Top member 16 has an upper support surface 22 secured to the floor 22 and a bottom support surface 24 joined perpendicularly to the top of the web 20. Bottom member 18 has an upper support surface 26 fixed to the bottom of web 20 and a pair of side support surfaces 28 depending downwardly from the upper support surface 26. Top and bottom members 16, 18 are preferably equal in size, are square or rectangular in cross-section, and have a greater width than that of the web 20 so as to define a major load bearing element having the I-shaped cross-section shown in FIG. 1.

In accordance with the invention, a system or kit 10 for mounting a series of suspension ceiling panels 30 on a panel holding framework 32 beneath the I-joist 14 comprises a plurality of mounting clips 34 suspendable from the I-joist 14, a plurality of elongated, leveling rods 36 retained on the mounting clips 34 and a plurality of hangers 38 depending from the leveling rods 36 to support the panel holding framework 32 comprised of runners 40 and the ceiling panels 30 thereon.

For purposes of simplicity, a single mounting clip 34, leveling rod 36 and hanger 38 are described in connection with the single I-joist 14 and a single runner 40, it being understood that kit or system 10 may be provided with the desired number and appropriate size of mounting components in relation to the size of the I-joist 14 and floor 12.

Figure 4:
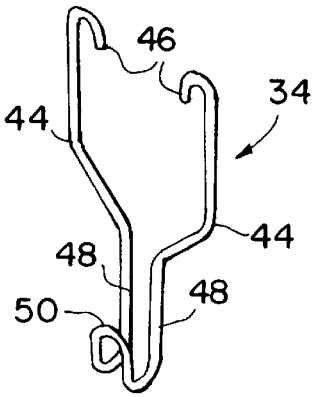
FIG. 4 is a perspective view of the mounting clip embodying the present invention.

As best seen in FIGS. 1 and 4, each mounting clip 34 is a one-piece member preferably drawn of hard wire, and includes a pair of spring-biased, hooked arms 42. Arms 42 have upper runs 44 which extend generally upwardly above the upper support surface 26 while hugging the side support surfaces 28 of bottom member 18. Upper runs 44 then curve upwardly and downwardly and inwardly towards the sides of the web 20, and terminate in substantially downwardly depending fingers 46 spaced from and extending substantially parallel to the sides of the web 20 and supported generally perpendicularly on the upper support surface 26 of bottom member 18. Arms 42 also include lower runs 48 converging downwardly towards and running parallel to each other to form a portion folded over upon itself and serving as an upwardly turned retainer loop 50 for supporting a panel holding framework assembly 52 at a distance beneath the I-joist 14.

Figure 5:
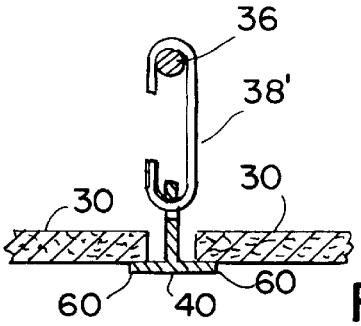
FIG. 5 is an elevational view similar to FIG. 3 but showing an alternative hanger contemplated by the present invention.

Slidably supported in the aligned retainer loops 50 of a group of mounting clips 34 are leveling rods 36 which extend generally transverse to the longitudinal axis of the web 20. Each rod 36 is generally cylindrical in shape and together with the retainer loop defines a mounting position by which the panel holding framework 32 is laterally shiftable thereon. Each hanger 38 has a first hooked end 54 engageable with and slidable along one of the leveling rods 36 and a second hooked end 56 engageable with an aperture 58 formed in panel holding framework 32. FIG. 5 depicts an alternative hanger 38' which is used when it is desired to hang ceiling panels 30 at a shorter distance from bottom member 18. As is well known, panel holding framework 32 is comprised of suspended grid system of runners 40 extending generally transversely to a group of intersecting cross-tees (not shown). Besides being formed with spaced apertures 58, each of the runners 40 is provided with laterally extending flanges 60 for removably and slidably supporting ceiling panels thereon. Collectively, rods 36, hangers 38, runners 40, and ceiling panels 30 define the panel holding framework assembly 52.

The installation of a suspension ceiling is effected as follows:

Once the center point of the ceiling is determined, mounting clips 34 are conveniently secured along the length of each I-joist 14 by spreading the resiliently biased arms 42 on opposite sides of web 20 and releasing the arms 42 such that the fingers 46 will self-locate and lock upon upper support surface 26 of bottom member 18, and the upper runs 44 of the arms 42 will hug tightly against the side support surfaces 28 of bottom members 18. The snapping of the arms 42 over the bottom member 18 thus automatically establishes the proper position from which panel holding framework 32 is mounted. With the mounting clips 34 retained by spring force upon the I-joists 14, the leveling rods 36 may be added, each rod 36 being slidably threaded through an aligned series of retainer loops 50. Next, the upper ends of hangers 40 are hooked upon the leveling rods 36 and the lower ends of the hangers 40 are hooked into the apertures 58 on the runners 40, the slidable mounting of the hangers 40 allowing the panel holding framework 32 to be self-adjusting. After the support grid has been formed, the installer simply lays the ceiling panels 30 upon the flanges 60 of the panel holding framework 32.

It should be appreciated that the mounting system 10 described self compensates for minor deviations in the bottom member 18 since the leveling rods 36 will vertically position themselves in the retainer loops 50. Unlike prior art systems, there is no need to accurately align connectors or holes on the joists 14 or mounting clips 34. There is also no need to drill holes and use additional fasteners in securing the mounting clips 34 to the I-joists 14. Use of the present invention is generally safer than prior art systems because there is no stringing of wire, no pounding of nails or eye bolts, and no handling of sharp or heavy parts.

Instead, the mounting clips 34, leveling rods 36 and hangers 38 are smooth, rounded, light-weight components which come in a variety of sizes to easily accommodate any existing ceiling or floor structure.

The resulting product is a suspension ceiling which is substantially free of sagging and bowing. The system of the present invention makes it particularly easy to replace existing ceiling panels or access the space between the floor and the suspension ceiling for plumbing, electrical or duct work repair. The manageable size of the components and the self-locating and locking aspects of the system help minimize the cost associated with the construction and installation of a suspension ceiling. The system makes optimal use of the inherent shape of the supporting I-joists without having to alter any surfaces on the existing structure.

While the invention has been described with reference to a preferred embodiment, those skilled in the art will appreciate that certain substitutions, alterations and omissions may be made without departing from the spirit thereof. Accordingly, the foregoing description is meant to be exemplary only, and should not be deemed limitative on the scope of the invention set forth with following claims.

I claim:

1. A ceiling construction comprising:

a joist connected to a floor, said floor being located above said ceiling and forming part of said ceiling construction;

a plurality of mounting clips suspended from said joist;

a plurality of ceiling panels;

a panel holding framework suspended beneath said joist;

a plurality of elongated leveling rods retained in said mounting clips in a substantially horizontal orientation extending generally transverse to a longitudinal axis of said joist; and a plurality of hangers dependent from and removably mounted on said leveling rods, said leveling rods supporting said panel holding framework and said ceiling panels therein, wherein said joist includes a top member secured to said floor, a bottom member having a substantially flat upper support surface and a pair of substantially flat side support surfaces, wherein said upper support surface and said side support surfaces support said mounting clip, said joist further including a web interconnecting said top member and said bottom member, wherein each of said mounting clips is constructed of drawn wire and includes a pair of resilient arms which engage said upper support surface of said bottom member, wherein said arms include parallel upper runs which engage against said side support surfaces of said bottom member, and wherein said parallel upper runs converge towards each other and form parallel lower runs which eventually merge together forming an upturned retainer loop in which one of said leveling rods is slidably supported.

2. The ceiling construction of claim 1, wherein said bottom member has a width greater than the width of said web.

3. The ceiling construction of claim 1, wherein each of said mounting clips is self-locating along the entire length of said joist.

4. The ceiling construction of claim 1, wherein each of said mounting clips is self-locking on said joist.

5. The ceiling construction of claim 1, wherein each of said hangers has a first hooked end engageable with one of said leveling rods and a second hooked end engageable within an aperture formed in said panel holding framework.

6. The ceiling construction of claim 1, wherein said panel holding framework is provided with laterally extending flanges for removably supporting said panels thereon.

7. A ceiling construction comprising:

a floor supporting joist having laterally horizontally and vertically extending support surfaces;

a series of ceiling panels;

at least one resilient mounting clip suspended from said support surfaces, said mounting clip being formed with a pair of spring biased hooked arms constructed and arranged to self-locate upon said support surfaces, and an upturned retainer loop positioned in spaced relationship to said joist; and a panel holding framework assembly supported from said upturned retainer loop and including a panel holding framework supporting said ceiling panels, wherein said hooked arms include a first set of parallel runs which engage said vertically extending support surfaces and extend upwardly above said support surfaces and terminate in downwardly depending fingers biased against and supported on said laterally, horizontally extending support surfaces, wherein said depending fingers extend substantially perpendicularly to said laterally, horizontally extending support surfaces, and wherein said upturned retainer loop is formed by a second set of parallel runs of said hooked arms which merge together and are folded over upon themselves.

8. The system of claim 7, wherein said retainer loop defines a mounting position by which said panel holding framework assembly is laterally shiftable thereon.

9. A suspension ceiling construction, comprising;

a floor supporting joist having a web joined to a support member, said support member having a pair of substantially flat upper support surfaces extending laterally and perpendicularly from the web and a pair of substantially flat side support surfaces extending downwardly and vertically from the upper support surfaces;

a panel holding framework assembly suspended beneath said joist;

a series of ceiling panels removably mounted on a panel holding framework assembly;

a mounting clip supporting and spacing the panel holding framework assembly from the joist, the mounting clip comprising:

a one-piece, resilient wire member having a pair of hooked arms, said hooked arms having parallel upper runs extending generally upwardly and vertically against said flat side support surfaces of said support member, curving inwardly towards said web and terminating in substantially downwardly depending fingers supported n said flat upper support surfaces of said support towards each other and thereafter running parallel to each other and merging together forming an upturned retainer loop supporting said panel holding framework assembly at a distance spaced beneath said joist.

10. The ceiling construction of claim 9, wherein said fingers extend substantially parallel to said web and substantially perpendicular to said upper surfaces of said support member.

11. The ceiling construction of claim 9, wherein said fingers are self-locating along said upper support surfaces of said support member.

12. The ceiling construction of claim 9, wherein said panel holding framework assembly includes a leveling rod slidably supported in said retainer loop such that said leveling rod is transverse to a longitudinal axis of said web.

13. The ceiling construction of claim 12, wherein said panel holding framework assembly further includes a hanger extending downwardly between said leveling rod and said panel holding framework.

* * * * *

UNITED STATES PATENT AND TRADEMARK OFFICE

CERTIFICATE OF CORRECTION

PATENT NO. : 5,768,843

DATED : June 23, 1998

INVENTOR(S) : Jerome j. dziedzic

It is certified that error appears in the above-indentified patent and that said Letters Patent is hereby corrected as shown below:

In The Claims

Col. 8, line 10, CLAIM 9, After "supported" delete "n" and insert ---on---; Col. 8, line 11, CLAIM 9, After "support" insert ---member; and---; Col. 8, Line 11, CLAIM 9, Before "towards" (as a new paragraph) insert ---parallel lower runs connected with said upper runs converging---

Signed and Sealed this

Twenty-ninth Day of September, 1998

*Attest:*

Bruce Lehman

BRUCE LEHMAN

*Attesting Officer*

*Commissioner of Patents and Trademarks*